US005754203A

United States Patent [19]

Kinoshita

[11] Patent Number: 5,754,203

[45] Date of Patent: May 19, 1998

[54] ACTUATOR PLATE STRUCTURE FOR AN INK EJECTING DEVICE

[75] Inventor: Masayoshi Kinoshita, Nagoya, Japan

[73] Assignee: Brother Kogyo Kabushiki Kaisha, Nagoya, Japan

[21] Appl. No.: 527,084

[22] Filed: Sep. 12, 1995

[30] Foreign Application Priority Data

Oct. 18, 1994 [JP] Japan ..... 6-252262

[51] Int. Cl.[6] ..... B41J 2/045

[52] U.S. Cl. ..... 347/69

[58] Field of Search ..... 347/67, 71

[56] References Cited

U.S. PATENT DOCUMENTS

| | | | |
|---|---|---|---|
| 3,946,398 | 3/1976 | Kyser et al. . | |
| 4,549,141 | 10/1985 | Fukuchi et al. . | |
| 4,723,129 | 2/1988 | Endo et al. . | |
| 4,879,568 | 11/1989 | Bartky et al. . | |
| 4,887,100 | 12/1989 | Michaelis et al. . | |
| 4,992,808 | 2/1991 | Bartky et al. . | |
| 5,003,679 | 4/1991 | Bartky et al. . | |
| 5,028,936 | 7/1991 | Bartky et al. . | |
| 5,428,382 | 6/1995 | Shimosato et al. | 347/71 |
| 5,432,540 | 7/1995 | Hiraishi | 347/67 |
| 5,646,661 | 7/1997 | Asai et al. | 347/69 |

FOREIGN PATENT DOCUMENTS 0 612 623 A2 8/1994 European Pat. Off. .

*Primary Examiner*—Daniel P. Malley
*Attorney, Agent, or Firm*—Oliff & Berridge

[57] ABSTRACT

In an ink ejection device, second grooves having a width larger than the width of first grooves which are formed in a piezoelectric ceramic plate are formed on the end surface of the piezoelectric ceramic plate. A step portion is formed at an intersection portion between each of the first groove and each of the second grooves because the width of the second groove is larger than the first grooves. By depositing a conductive material from two directions above and to one side of the piezoelectric ceramic plate, driving electrodes and non-ejection channel lead wire electrodes are formed in the first grooves and on the inner surfaces of the slits by a shadow effect of the side walls on the second grooves. Furthermore, by depositing the conductive material from two directions below and to one side of the piezoelectric ceramic plate, ejection channel lead wire electrodes, wiring patterns connected to the ejection channel lead wire electrodes and wiring patterns connected to the non-ejection channel lead wire electrodes are formed on the inner surfaces of the second grooves by the shadow effect of the side walls on the second grooves. The ejection channel lead wire electrodes and the non-ejection lead wire electrodes are formed inside the first grooves in which the driving electrodes are formed, so that these electrodes are electrically connected to the driving electrodes.

23 Claims, 10 Drawing Sheets

ACTUATOR PLATE STRUCTURE FOR AN INK EJECTING DEVICE

BACKGROUND OF THE INVENTION

1. Field of the Invention

This invention generally relates to an ink ejecting device. Specifically, this invention relates to an ink ejecting device where the vertical slits for connecting the ink channels and air channels to the bottom surface of the ink ejecting device are wider than the ink channels and the air channels.

2. Description of the Related Art

A shear mode type drop-on-demand non-impact printer, as disclosed in U.S. Pat. No. 4,479,681, has been proposed. As shown in FIGS. 6A and 6B, a shear-mode type ink ejecting device 600 of the conventional shear-mode type non-impact printer comprises a bottom wall 601, a top wall 602 and a plurality of shear-mode actuator walls 603 which extend between the top and bottom walls 602 and 601. Each of the actuator walls 603 comprises a lower wall portion 607 and an upper wall portion 605. The lower wall portion 607 is adhesively attached to the bottom wall 601 and polarized in the direction indicated by an arrow 611. The upper wall portion 605 is adhesively attached to the top wall 602 and polarized in the direction indicated by an arrow 609. A pair of adjacent actuator walls 603 form the side walls of an ink channel 613. A space channel 615, which is narrower than the ink channel 613, is also formed between adjacent pairs of actuator walls 603. The space channels 615 are provided in an alternating relationship with the ink channels 613.

A nozzle plate 617, which has a plurality of nozzles 618 formed in it, is fixedly secured to one end of the plurality of ink channels 613. Electrodes 619 are provided, as metallized layers, on one side surface of each actuator wall 603. Electrodes 621 are also provided, as metallized layers, on the other side surface of each actuator wall 603. Each of the electrodes 619 and 621 is covered by an insulating layer (not shown) to insulate it from the ink. The electrodes 619 and 621 which face the space channels 615 are connected to ground 623, while the electrodes 619 and 621 which are provided in the ink channel 613 are connected to a silicon chip 625, which forms an actuator driving circuit.

To form the ink ejecting device 600, first, a first piezoelectric ceramic layer is adhesively attached to the bottom wall 601. The first piezoelectric ceramic layer is polarized in a direction indicated by an arrow 611. The second piezoelectric ceramic layer is polarized in a direction indicated by an arrow 609. The thickness of each of the first and second piezoelectric ceramic layers is equal to the height of each of the lower wall portions 607 and the upper wall portions 605, respectively. Subsequently, parallel grooves are formed in the first and second piezoelectric ceramic layers by rotating a diamond cutting disc or the like to leave the lower wall portions 607 and the upper wall portions 605. The electrodes 619 are formed on the side surfaces of the lower wall portions 607 by a vacuum-deposition method. The insulating layer, as described above, is then provided over the electrodes 619. Likewise, the electrodes 621 are provided on the side surfaces of the upper wall portions 605 and the insulating layer is then provided over the electrodes 621.

The free ends of the upper wall portions 605 and the lower wall portions 607 are adhesively attached to one another to form the ink channels 613 and the space channels 615. Subsequently, the nozzle plate 617 is adhesively attached to one end of the ink channels 613 and the space channels 615 so that the nozzles 618 connect to the ink channels 613. The other end of the ink channels 613 and the space channels 615 are connected to the silicon chip 625 and the ground 623.

A voltage is applied to the electrodes 619 and 621 of each ink channel 613 from the silicon chip 625. As a result, each actuator wall 603 suffers a piezoelectric shear mode deflection in a direction such that the volume of each ink channel 613 increases. The applied voltage is removed after a predetermined time elapses. As a result, the volume of each ink channel 613 returns from a volume-increased state to its natural state. Thus, the ink in the ink channel 613 is pressurized and an ink droplet is ejected from the corresponding nozzle 618.

However, in the ink ejecting device 600, the electrodes 619 and 621 facing the spaces 615 are connected to the ground 623 and the electrodes 619 and 621 provided in the ink channels 613 are connected to the silicon chip 625. Thus, the voltage is applied to the electrodes 619 and 621 in each ink channel 613 to eject the ink. Therefore, the electrodes 619 and 621 in the ink channels 613 must be coated with the insulating layer so they are electrically insulated from the ink. If no insulating layer is provided, a short circuit would occur through the highly conductive ink.

Further, even if the conductivity of the ink is not high, the electrodes 619 and 621 deteriorate due to electrical and/or chemical corrosion. Thus, the actuator wall 603 does not sufficiently deflect and the print quality is lowered. Accordingly, the insulating layer must be provided to electrically insulate the ink and the electrodes 619 and 621 from each other. Thus, equipment and a process for forming the insulating layers are required. As a result, the productivity in building the ink ejecting device 600 is lowered and the cost of the ink ejecting device 600 increases.

In order to solve these problems, the applicant of this application proposed a driving method for an ink ejecting device disclosed in U.S. patent application Ser. No. 08/323,721. The ink ejecting device using the driving method as described above is shown in FIGS. 7–9. As shown in FIGS. 7, 8 and 9, an ink ejecting device 300 comprises a piezoelectric ceramic plate 302, a cover plate 320, a nozzle plate (not shown) and a manifold member 301.

The piezoelectric ceramic plate 302 is formed of ceramic material, such as lead zirconate titanate (PZT) The piezoelectric ceramic plate 302 is machined using a diamond blade or the like to form a plurality of grooves 303 separated by a plurality of partition walls 306. The partition walls 306 form the side surfaces of the grooves 303 and are polarized in a direction indicated by an arrow 305. The grooves 303 have the same depth and are arranged in parallel to one another. The grooves 303 fully extend between the end surfaces 302A and 302B of the piezoelectric ceramic plate 302.

A plurality of slits 311A are formed on the end surface 302A of the piezoelectric ceramic plate 302, and connect to every other one of the grooves 303. Similarly, a plurality of slits 311B are formed on the end surface 302B of the piezoelectric ceramic plate 302 and connect to every other one of the grooves 303. In particular, the slits 311A and the slits 311B do not connect to the same ones of the grooves 303. Two of the slits 311A connect to the grooves 303 formed at the lateral ends of the piezoelectric ceramic plate 302. Two wiring patterns 324 and 325, as shown in FIG. 9, are formed on the bottom surface 302C of the piezoelectric ceramic plate 302.

Three sets of metal electrodes 308, 309 and 310 are formed by depositing metal from the directions indicated by the arrows 330A and 330B from a deposition source (not shown). The depositions source is located above and to the sides of both the top surface 302D and the end surface 302A of the piezoelectric ceramic plate 302, as shown in FIG. 7. In this case, the end surface 302A of the piezoelectric ceramic plate 302 and the top surfaces of the partition walls 306 are masked so that no metal electrode is formed on these portions. Accordingly, the metal electrodes 308 are formed only on the upper halves of both side surfaces of the grooves 303 by a shadow effect of the partition walls 306, as shown in FIG. 7.

Further, by the shadow effect, the metal electrodes 309 are partially formed on the bottom surfaces and the side surfaces of the grooves 303 on which no slit 311A is formed and which is located at the end surface 302A side. In addition, the metal electrodes 310 are formed on the end surfaces of the slits 311A and at the end surface 302A side by the shadow effect of the side walls of the slits 311A. The metal electrodes 308 and the metal electrodes 309 are electrically connected to each other, and the metal electrodes 308 and the metal electrodes 310 are electrically connected to each other.

Subsequently, metal electrodes 316 and 317 are formed, by depositing metal from the directions indicated by arrows 331A and 331B from a deposition source (not shown). The deposition source is disposed below and to the sides of both the bottom surface 302C and the end surface 302B of the piezoelectric ceramic plate 302, as shown in FIG. 9. In this case, the end surface 302B and the bottom surface 302C of the piezoelectric ceramic plate 302 are masked so that no metal electrode is formed on these portions. Accordingly, the metal electrodes 316 are formed on the bottom surface 302C of the piezoelectric ceramic plate 302 and on parts of the side surfaces of the inner surfaces of the slits 311A. At this time, the metal electrodes 316 are also formed on the metal electrodes 310 which are formed in the slits 311A. Thus, the metal electrodes 316 formed on the side surfaces of the slits 311A are electrically connected to the metal electrodes 308 through the metal electrodes 310. Therefore, the metal electrodes 308 formed on adjacent ones of the partition walls 306 and which face each other across each groove 303B are electrically connected to each other by one of the metal electrodes 316.

As shown in FIGS. 8 and 9, the metal electrode 317 is formed on an area extending from the central portion side of the piezoelectric ceramic plate 302 to the end surface 302B side on the bottom surface 302C of the piezoelectric ceramic plate 302, on the whole inner side surfaces of the slit 311B and at the end surface 302B side of the slit 311B. At this time, the metal electrodes 317 are also formed on the metal electrodes 308 of the grooves 303B which connect to the slits 311B. Thus, the metal electrodes 317 are electrically connected to the metal electrodes 308 which are formed on the side surfaces of the slits 311B. Therefore, all of the metal electrodes 308 of the grooves 303B in which the slits 311B are formed are electrically connected to the metal electrodes 317. Furthermore, the metal electrodes 317 are also electrically connected to the wiring pattern 325.

Subsequently, a cover plate 320 of alumina is formed. The top surface 302D of the piezoelectric ceramic plate 302 is adhesively attached to the cover plate 320 through an epoxy-based adhesive (not shown). Accordingly, in the ink ejecting device 300, the upper surfaces of the grooves 303B are covered to form ink channels 304 connected to the slits 311B and the upper surfaces of the grooves 303A are covered to form air channels 327 connected to the slits 311A. The ink channels 304 and the air channels 327 are designed to have a slender shape having a rectangular cross section. All of the ink channels 304 are filled with ink, and all of the air channels 327 are filled with air.

A nozzle plate (not shown) is adhesively attached to the end surface 302A of the piezoelectric ceramic plate 302 and the end surface of the cover plate 320. The nozzles in the nozzle plate are formed at positions corresponding to the respective ink channels 304. The nozzle plate is formed of plastic material, such as polyalkylene (for example, ethylene) terephthalate, polyamide, polyether imide, polyether ketone, polyether sulfone, polycarbonate, cellulose acetate or the like.

Subsequently, the manifold member 301 is adhesively attached to the end surface 302B of the piezoelectric ceramic plate 302 and the slit 311B side on the bottom surface 302C of the piezoelectric ceramic plate 302. A manifold 301 is formed in the manifold member 322. The manifold 322 surrounds and connects to the slits 311B to supply ink to the ink channels 304.

Next, the wiring patterns 324 and 325, which are formed on the surface 302C of the piezoelectric ceramic plate 302, are connected to a wiring pattern of a flexible print board (not shown). The wiring pattern of the flexible print board is connected to a controller (not shown). The controller identifies, for each print data signal, through which ones of the nozzles the ink droplets are to be ejected. The controller thus applies a voltage V to the wiring patterns 324 which are connected to the metal electrodes of the air channels 327 on both sides of an ink channel 304 through which the ink is to be ejected. In addition, the other wiring patterns 324 corresponding to the non-ejecting ink channels 304 and the patterns 325 connected to the metal electrodes 308 of the ink channels 304 are set at 0 V (i.e. grounded) by the controller. In the ink ejecting device 300, the metal electrodes 308 in the ink channels 304 are grounded at all times. Thus, it is not necessary to electrically insulate the metal electrodes 308 are from the ink.

In the ink ejecting device 300 as described above, the plurality of grooves 303 and the slits 311A and 311B connecting to the grooves 303 are formed in the piezoelectric ceramic plate 302. Then, the metal electrodes 308, 309 and 310 are formed by deposition from a direction above and to the sides of the piezoelectric plate 302. In this case, when the slits 311A and 311B have the same width, an area remains in which no metal electrode is formed by the deposition from the directions indicated by arrows 330A, 330B, 331A, 331B if the grooves 303 and the slits 311A and 311B positionally deviate from each other.

For example, if a positional deviation or displacement between the groove 303A and the slit 311A occurs, as shown in FIG. 10, an area A remains in which no metal electrode is formed by the deposition from the directions indicated by the arrows 330A and 330B. Therefore, the metal electrode 310 of the slit 311A and the metal electrode 308 of the groove 303A are not electrically connected to each other. Thus, no ink is ejected from the ink channel 304 adjacent to this channel 303A. Therefore, when an area A remains in which no metal electrode is formed even by the deposition from the directions as indicated by the arrows 330A, 330B, 331A and 331B, the metal electrodes 308 and the metal electrodes 310 and 317 in the neighborhood of the slits 311A and 311B may not be electrically connected to one another.

In order to form an ink ejecting device so that no positional deviation or displacement occurs between the grooves and the slits 311A and 311B, the grooves 303 and the slits 311A and 311B must be formed in the same step. In order to perform such processing, a high-tech three-dimensional cutting method using a diamond cutting disc or the like is required. Therefore, a high-cost cutting device must be used, and a long cutting time is required, so that the productivity is lowered and the cost of the ink ejecting device 300 increases.

SUMMARY OF THE INVENTION

This invention thus provides an ink ejecting device which can be formed using a simple process and has high productivity and high reliability.

In the ink ejecting device of this invention, the ink ejecting device comprises first grooves which are formed in an actuator plate for ejecting ink, second grooves which are formed in the depth direction of the first grooves and connect to the first grooves, first electrodes which are formed in prescribed areas on the inner surfaces of the first grooves by utilizing a shadow effect of the first side walls of the first grooves, and second electrodes which are formed on the inner surfaces of the second grooves by utilizing a shadow effect of the side walls of the second grooves and are electrically connected to the first electrodes, wherein the width of the second grooves, in the areas in which the first electrodes of the first grooves are formed, is larger than the width of the first grooves. Thus, the first electrodes, which are formed by the shadow effect of the side walls of the first grooves, and the second electrodes, which are formed by the shadow effect of the side walls of the second grooves, are electrically connected to one another even when a positional deviation or displacement between the first grooves and the second grooves occurs. Therefore, the ink can be ejected without fear of an electrical disconnection between the first electrodes and the second electrodes. Furthermore, when the first groove and the second grooves are formed, only a linear cutting work is carried out, so that no high-cost equipment to perform a three-dimensional machining is required. Thus the cost of the ink ejecting device is reduced.

These and other features and advantages of the invention are described in or apparent from the following detailed description of the preferred embodiments.

BRIEF DESCRIPTION OF THE DRAWINGS

A preferred embodiment of the present invention will be described in detail, with reference to the following figures, wherein.

DETAILED DESCRIPTION OF THE PREFERRED EMBODIMENT

Figure 1:
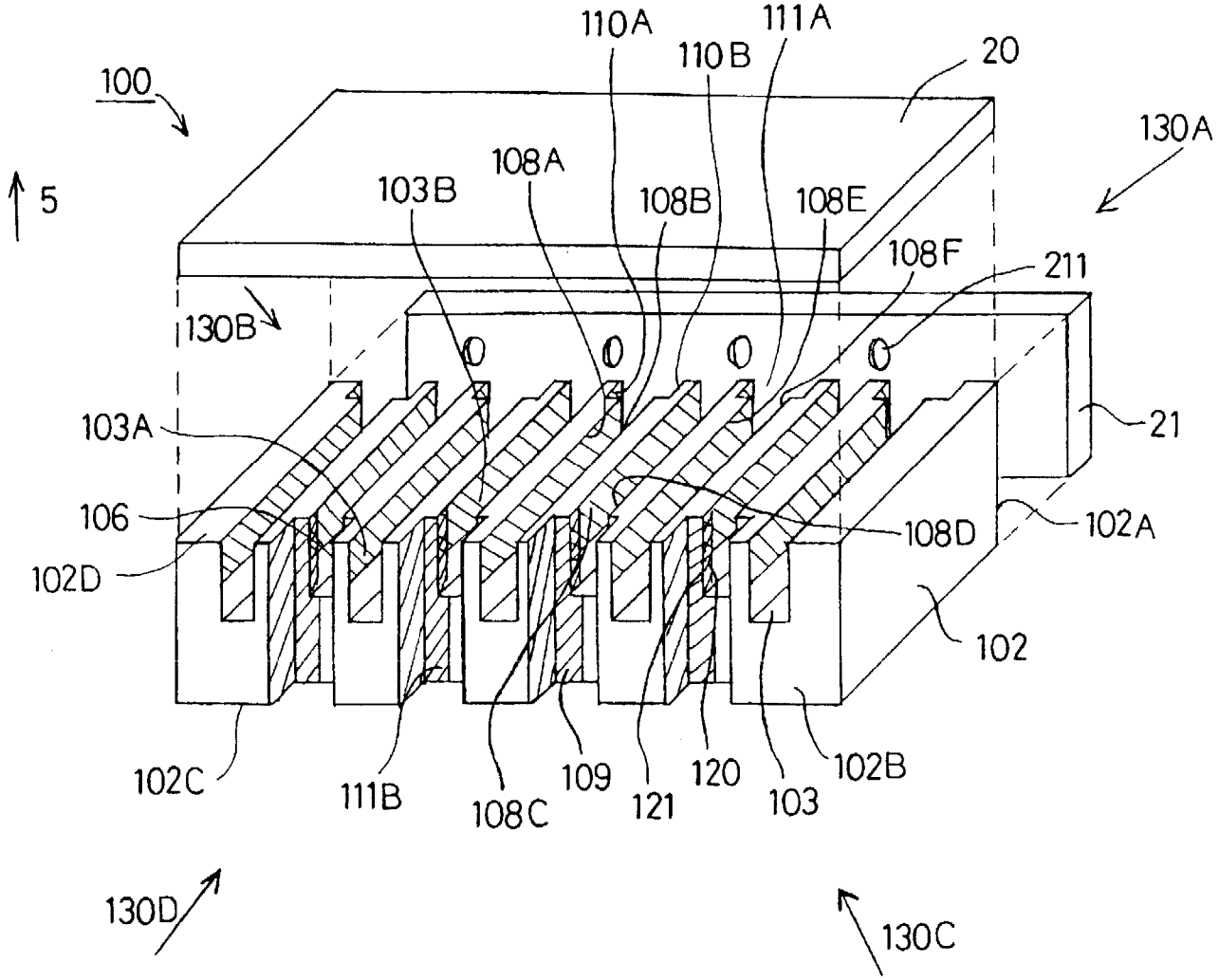
FIG. 1 is a top perspective view showing of a preferred embodiment of an ink ejecting device according to this invention.
Figure 2:
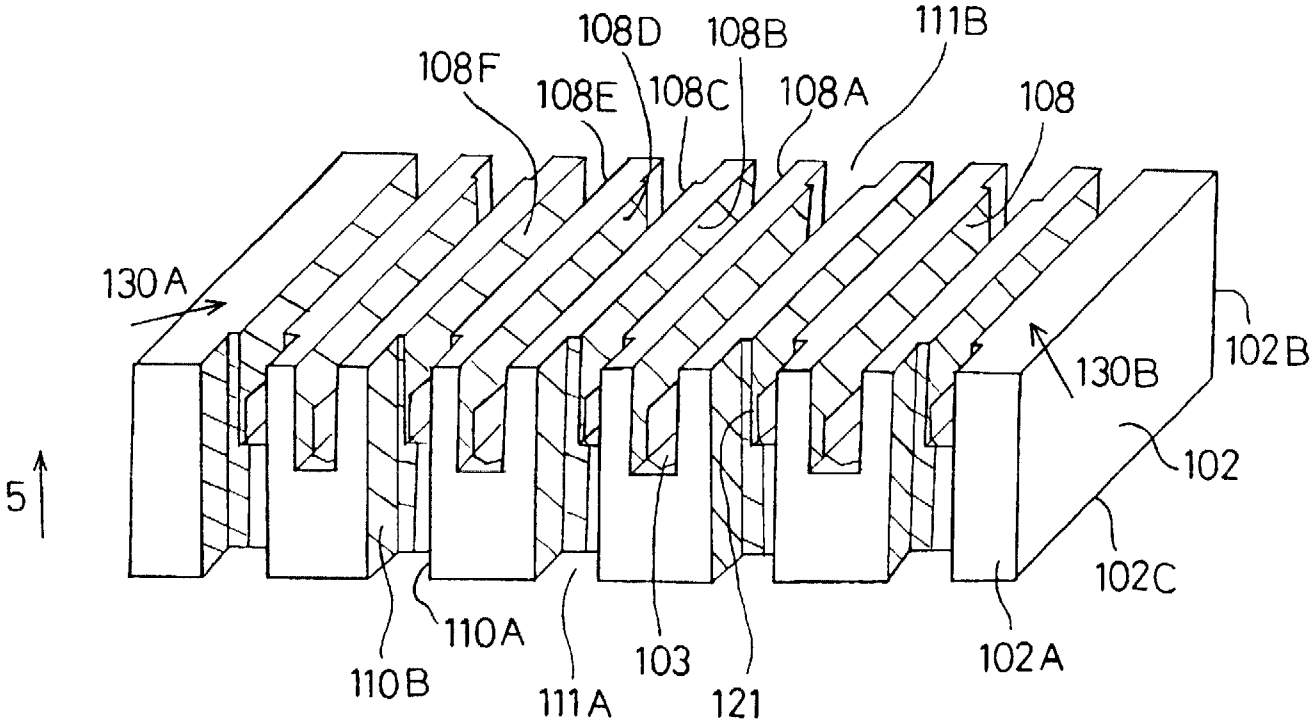
FIG. 2 is a top perspective view of a piezoelectric ceramic plate of the preferred embodiment.
Figure 3:
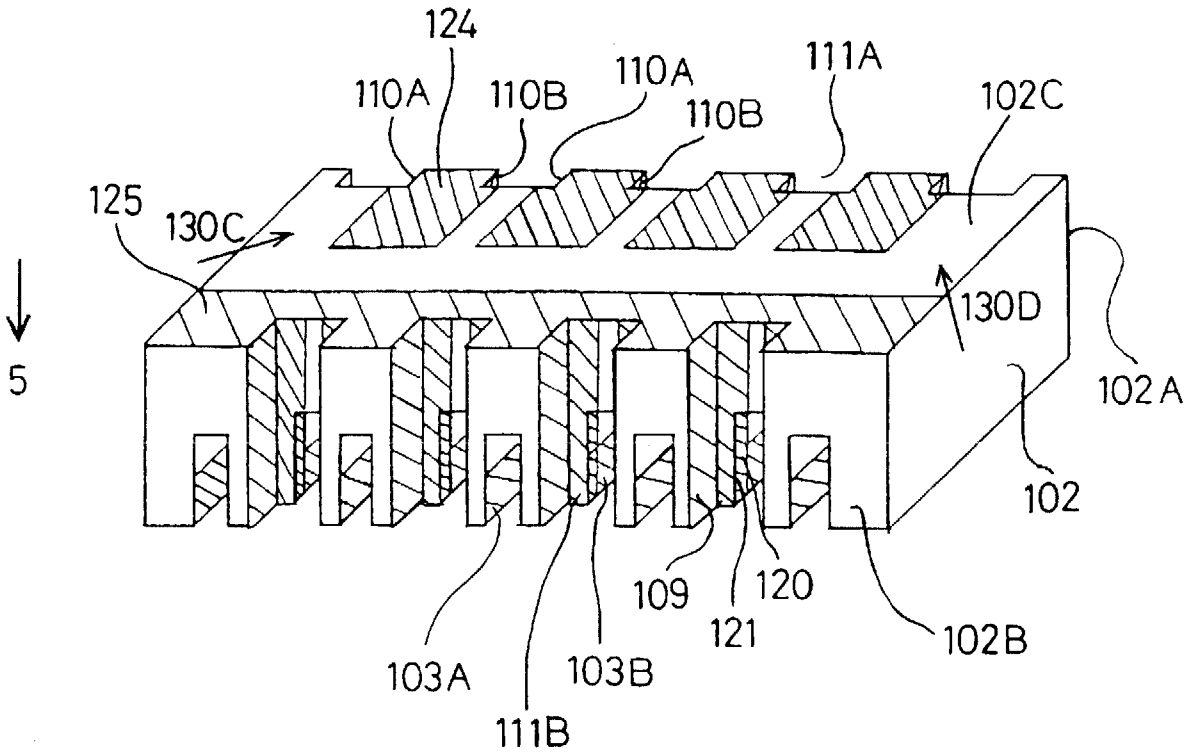
FIG. 3 is a bottom perspective view of the piezoelectric plate of the preferred embodiment.
Figure 9:
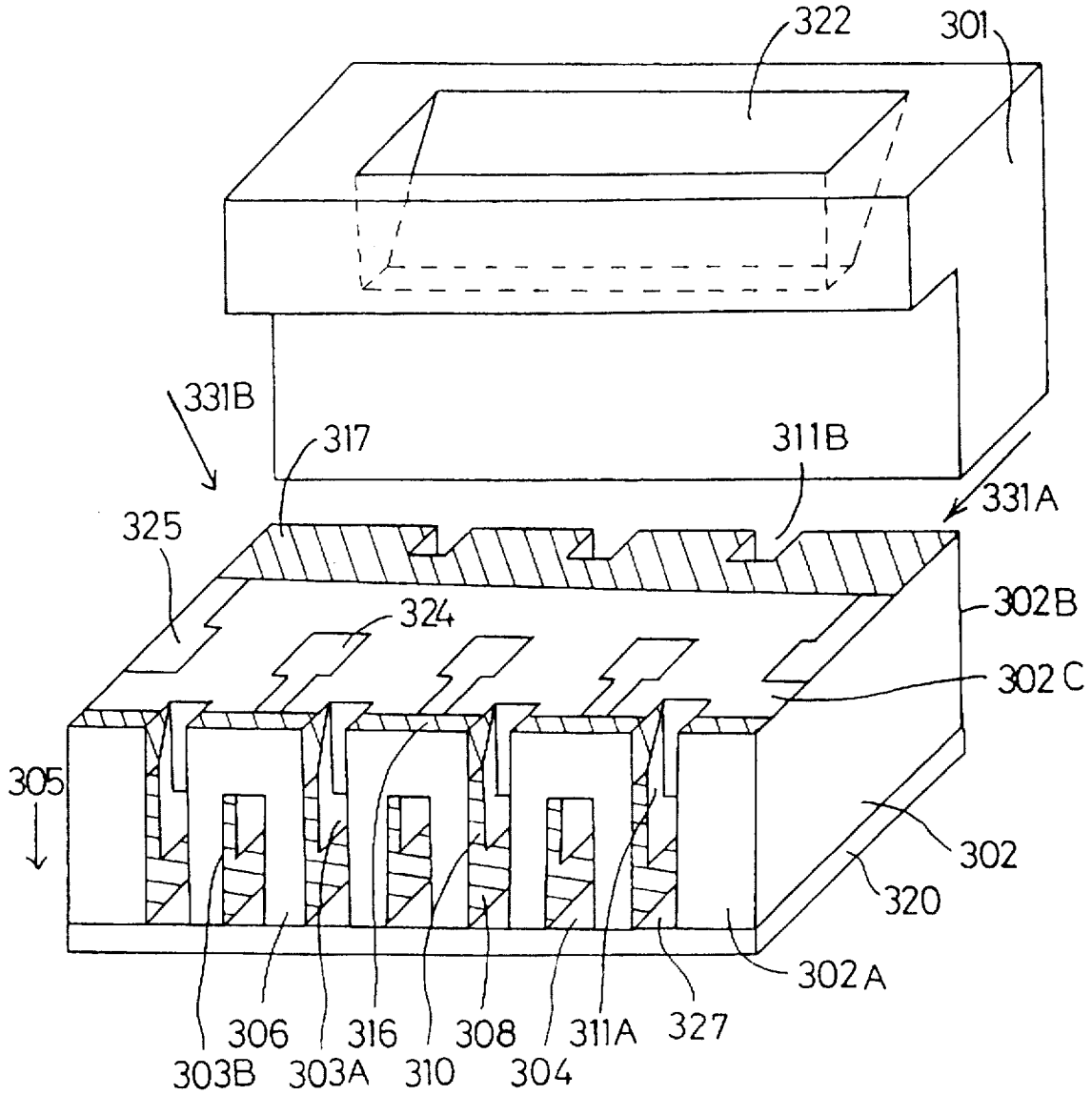
Fig.9 RELATED ART
FIG. 9 is a bottom perspective view of the second conventional ink ejecting device.
Figure 10:
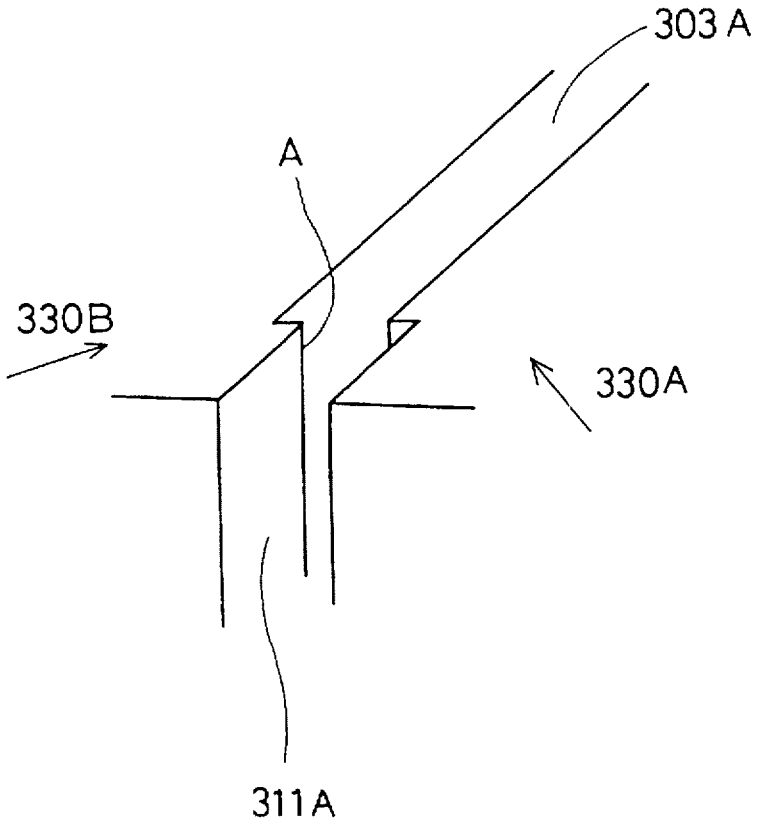
Fig.10 RELATED ART
FIG. 10 is a top perspective view of a portion of the piezoelectric ceramic plate of the second conventional ink ejecting device showing the positional deviation between the vertical and horizontal grooves.

As shown in FIGS. 1, 2 and 3, a preferred embodiment of an ink ejecting device 100 comprises a piezoelectric ceramic plate 102 forming an actuator plate, a cover plate 20, a nozzle plate 21 and a manifold member (not shown). The manifold member is generally the same as the conventional manifold member 301 shown in FIG. 9. The manifold member is adhesively attached to both the bottom surface 102C and the end surface 102B of the piezoelectric ceramic plate 102. The nozzle plate 21 is adhesively attached to the end surface 102A of the piezoelectric ceramic plate 102.

The piezoelectric ceramic plate 102 formed of ceramic material, such as lead zirconate titanate (PZT) or the like, and is first machined using a diamond blade to form a plurality of grooves 103 and a plurality of partition walls 106 in the piezoelectric ceramic plate 102. The partition walls 106 form the side surfaces of the grooves 103 and are polarized in a direction indicated by an arrow 5. Each of the plurality of grooves 103 have the same depth and are parallel to one other. Each of the grooves 103 fully extends between the end surfaces 102A and 102B of the piezoelectric ceramic plate 102. Accordingly, the grooves 103 are linearly processed.

Next, the piezoelectric ceramic plate 102 machined with a diamond blade, whose width is larger than the width of the diamond blade used to form the plurality of grooves 103, to form a plurality of grooves 111A in the end surface 102A of the piezoelectric ceramic plate 102. The plurality of second grooves 111A connect to every other groove 103A of the grooves 103A. Each of the second grooves 111A has a width which is larger than the width of the grooves 103. The laterally outermost grooves 103 formed in the piezoelectric ceramic plate 102 connect with corresponding ones of the second grooves 111A. Likewise, a plurality of second grooves 111B are formed in the end surface 102B of the piezoelectric ceramic plate 102. The plurality of second grooves 111B connect to every other groove 103B of the grooves 103. Each of the second grooves 111B has width which is larger than the width of the grooves 103.

Step portions 121 are thus formed at the intersection between each groove 103A and the corresponding one of the second grooves 111A, and at the intersection between each groove 103B and the corresponding one of the second grooves 111B. The step portions 121 are formed because the width of the second grooves 111A and 111B is larger than the width of the grooves 103. Since the width of the second grooves 111A or 111B is larger than the width of the grooves 103, if a positional deviation between the grooves 103 and the second grooves 111A and 111B occurs, the positional deviation does not cause the electrode 108 to be disconnected from the electrodes 109 or 110, so long as the positional deviation is not greater than one-half of the difference in the widths of the second grooves 111A or 111B and the grooves 103. Accordingly, the width of the second grooves 111A and 111B is determined based on the expected positional deviation between the second grooves 111A and 111B and the grooves 103. For example, the positional deviation is generally at most about 5 μm, due to a general processing error. Thus, the width of the second grooves 111A and 111B should be set to at least 10 μm wider than the width of the grooves 103.

Subsequently, a masking treatment to form the wiring patterns 124 and 125 is carried out on the bottom surface 102C of the piezoelectric ceramic plate 102. Thereafter, conductive material, preferably metal of 99.9% purity, such as nickel, aluminum or the like, is deposited on the piezoelectric ceramic plate 102 from a deposition source (not shown) which is disposed above and to the side the piezoelectric ceramic plate 102, to form the driving electrodes 108, the ejection channel lead wire electrodes 109 and the non-ejection channel lead wire electrodes 110. In particular, the conductive material is deposited from the four directions indicated by the arrows 130A, 130B, 130C and 130D.

As shown in FIG. 2, by the shadow effect of the partition walls 106, the driving electrodes 108A, 108C, 108E, etc. are formed on the right side surfaces of the grooves 103 in FIG. 2 (the left side surfaces of the grooves 103 in FIG. 1), and by the shadow effect of the side walls of the second grooves 111A, the non-ejection channel lead wire electrodes 110A are formed on the central right side surfaces of the second grooves 111A (the left side surfaces in FIG. 1). The driving electrodes 108A, 108C, 108E, etc. of the left side surfaces of the grooves 103A are electrically connected to the non-ejection channel lead wire electrodes 110A.

Furthermore, the driving electrodes 108B, 108D, 108F, etc. are formed on the left side surfaces of the grooves 103 in FIG. 2 (the right side surfaces of the grooves 103 in FIG. 1) by depositing the conductive material from a deposition source from the direction indicated by the arrow 130B by the shadow effect of the partition walls 106. The non-ejection channel lead wire electrodes 110B are formed on the central left side surfaces of the second grooves 111A by the shadow effect of the side walls of the second grooves 111A (the right side surfaces in FIG. 1). The driving electrodes 108B, 108D, 108F, etc. of the grooves 103A and the non-ejection channel lead wire electrodes 110B are electrically connected to each other.

Furthermore, as shown in FIG. 3, by depositing the conductive material from the directions indicated by the arrows 130C and 130D, the ejection channel lead wire electrodes 109 are formed on the inner surfaces of the second grooves 111B by the shadow effect of the slits 111B, and the wiring patterns 124 and 125 are formed. The ejection channel lead wire electrodes 109 are formed on the side surfaces of the second grooves 111B, on parts of the bottom surfaces of the second grooves 111B and at portions in the grooves 103B. The electrodes which are formed at the portions in the grooves 103B are referred to as "in-groove lead wire electrodes 120". The ejection channel lead wire electrodes 109 are electrically connected to the driving electrodes 108 of the grooves 103B by the in-groove lead wire electrodes 120. The deposition directions indicated by the arrows 130C and 130D are determined so that these ejection channel lead wire electrodes 109 are formed.

After the formation of the electrodes 108, 109, 110 and 120, chipping may occur at the step portions 121, corresponding to the intersection region between the grooves 103B and the second grooves 111B, due to cracks created during the cutting process when forming the second grooves 111B. Thus, the step portions 121 can be chipped by several micrometers. The width of the in-groove lead wire electrodes 120 in the grooves 103 is set to 10 μm or more to ensure the electrodes 109 are electrically connected to the electrodes 108 even when chipping has occurred. By forming the ejection channel lead wire electrodes 109 as described above, the reliability to the electrical connection between the ejection channel lead wire electrodes 109 and the driving electrodes 108 is improved.

The end surfaces 102A and 102B of the piezoelectric ceramic plate 102 are masked with metal, resin or the like, or metal which is attached to these end surfaces 102A and 102B in the process of forming the electrodes is removed by a grinding treatment or the like after the electrode forming process. Thus, the driving electrodes 108 of the neighboring channels are not inadvertently electrically connected to each other.

As shown in FIG. 3, the wiring patterns 124 and 125 are formed by depositing the conductive material from the directions indicated by the arrows 130C and 130D. The wiring patterns 124 are formed on the surface 102C from the bottom surfaces of the slits 111A to an area extending from the central side of the piezoelectric ceramic plate 102 to the end surface 102A, and at portions corresponding to the grooves 103B. Each wiring pattern 124 is also formed at parts of the surfaces of the two slits 111A sandwiching each groove 103B, at the side of the groove 103B. Each wiring pattern 124 is electrically connected to the non-ejection channel lead wire electrodes 110A and 110B. Accordingly, the two driving electrodes (for example, the driving electrodes 108B and 108E) of two partition walls 106 defining each groove 103B, which are at the side of the grooves 103A, are electrically connected to the wiring patterns 124 through the non-ejection channel lead wire electrodes 110A and 110B.

The wiring pattern 125 is formed from the bottom surfaces of the second grooves 111B to the whole area extending from the central side of the piezoelectric ceramic plate 102 to the end surface 102B. The wiring pattern 125 is electrically connected to the ejection channel lead wire electrodes 109. Accordingly, the driving electrodes 108 of all the grooves 103B are electrically connected to the wiring pattern 125 through the ejection channel lead wire electrodes 109.

Subsequently, the cover plate 20 is formed of alumina, and the top surface 102D of the piezoelectric ceramic plate 102 is adhesively attached to the cover plate 20 with an epoxy-based adhesive 140, as shown in FIG. 5. Accordingly, in the ink ejection device 100, the upper surfaces of the grooves 103 are covered by the cover plate 20 to form ink channels 104 connected to the slits 111B and air channels 127 connected to the slits 111A. The ink channels 304 correspond to the grooves 103B, and the air channels 127 correspond to the grooves 103A. The ink channels 104 and the air channels 127 are designed to have a slender shape having a rectangular cross section. All of the ink channels 104 are filled with ink, and all of the air channels 127 are filled with air.

The nozzle plate 21 has a plurality of nozzles 211 formed in it, with each nozzle 211 connected to a corresponding one of the ink channels 104. The nozzle plate 21 is adhesively attached to the end surface 102A of the piezoelectric ceramic plate 102 and the end surface of the cover plate 20. The nozzle plate 21 is formed of plastic material such as polyalkylene (for example, ethylene) terephthalate, polyimide, polyether imide, polyether ketone, polyether sulfone, polycarbonate, cellulose acetate or the like.

The manifold member is adhesively attached to the end surface 102B of the piezoelectric ceramic plate 102 and the second grooves 111B side on the bottom surface 102C of the piezoelectric ceramic plate 102. The manifold member is provided with a manifold. The manifold surrounds the slits 111B.

The wiring patterns 124 and 125, which are formed on the bottom surface 102C of the piezoelectric ceramic plate 102, are connected to a wiring pattern of a flexible print board (not shown). The wiring pattern of the flexible print board is connected to a rigid board (not shown) connected to a controller 151 shown in FIG. 4.

Figure 4:
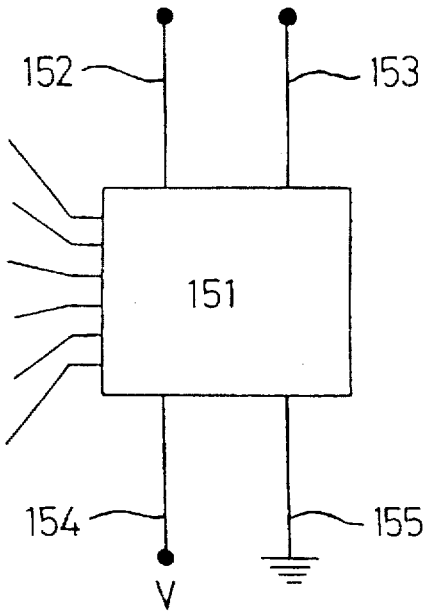
FIG. 4 is a block diagram of a controller of the preferred embodiment of the ink ejecting device.

As shown in FIG. 4, each of the wiring patterns 124 and 125 is individually connected to an LSI chip 151 through the flexible print board and the rigid board. A clock line 152, a data line 153, a voltage line 154 and a ground line 155 are also connected to the LSI chip 151. On the basis of sequential clock pulses supplied from the clock line 152, the LSI chip 151 determines, from print data appearing on the data line 153, which ones of the nozzles 211 should ejects ink droplets. The LSI chip 151 then applies a voltage V of the voltage line 154 to the wiring patterns 124 which are connected to the driving electrodes 108 of the air channels 127 which sandwich the ink channels 104 through which the ink should be ejected. The other wiring patterns 124 and the wiring pattern 125, which are connected to the driving electrodes 108 of the non-ejecting ones of the ink channels 104, are connected to the ground line 155.

Figure 5A:
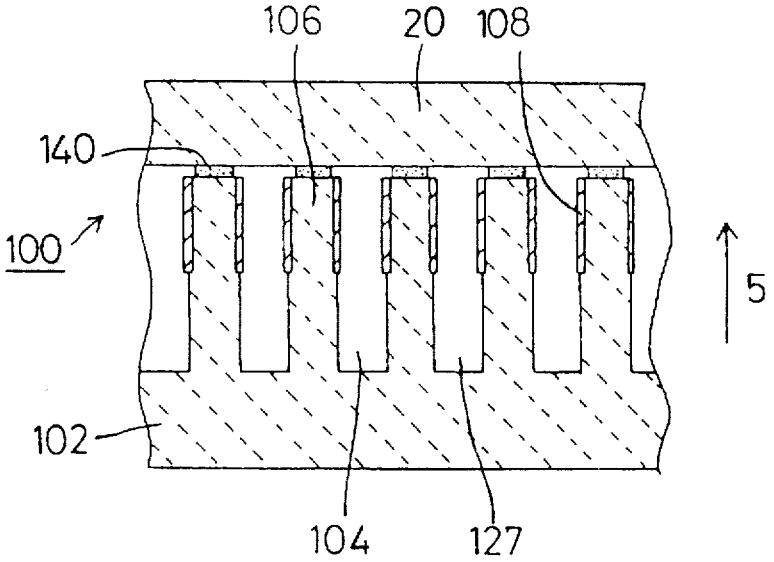
FIGS. 5A and 5B are diagrams illustrating the operation of the preferred embodiment of the ink ejecting device.
Figure 5B:
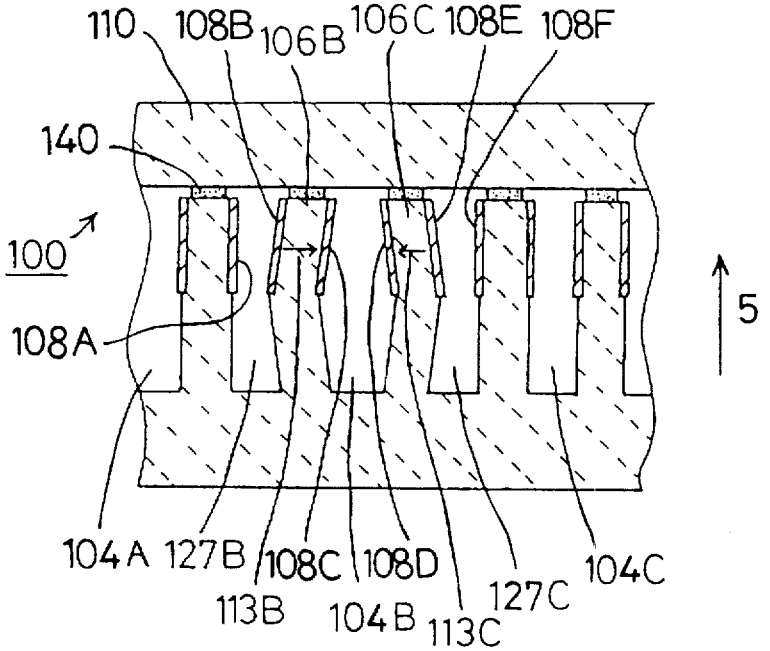
Figure 6A:
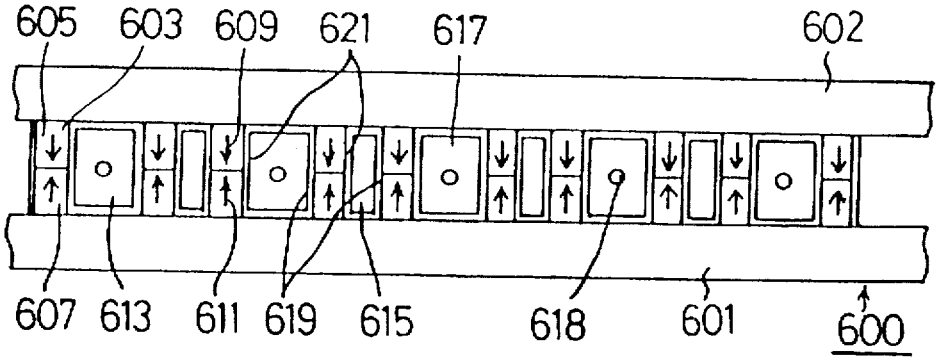
Fig.6A PRIOR ART
FIGS. 6A and 6B are front and top views of a first conventional ink ejecting device.
Figure 6B:
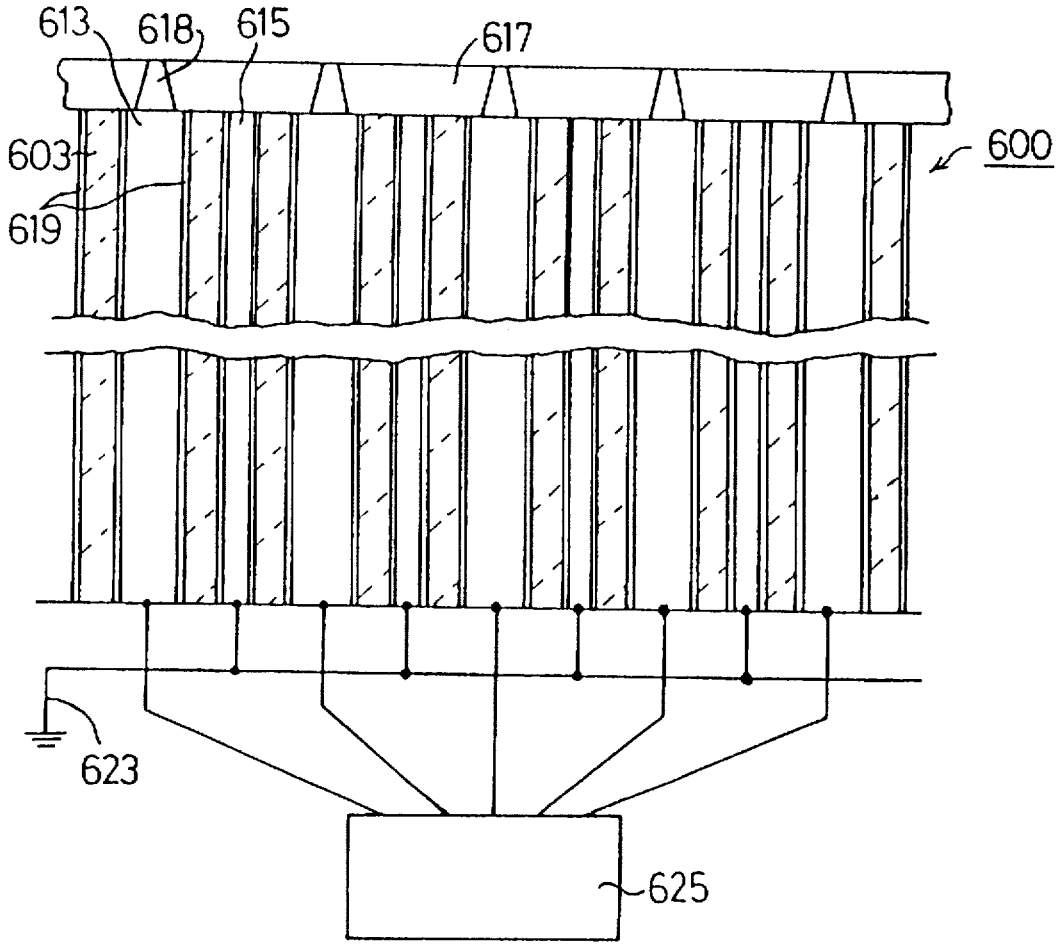
Fig.6B PRIOR ART
Figure 7:
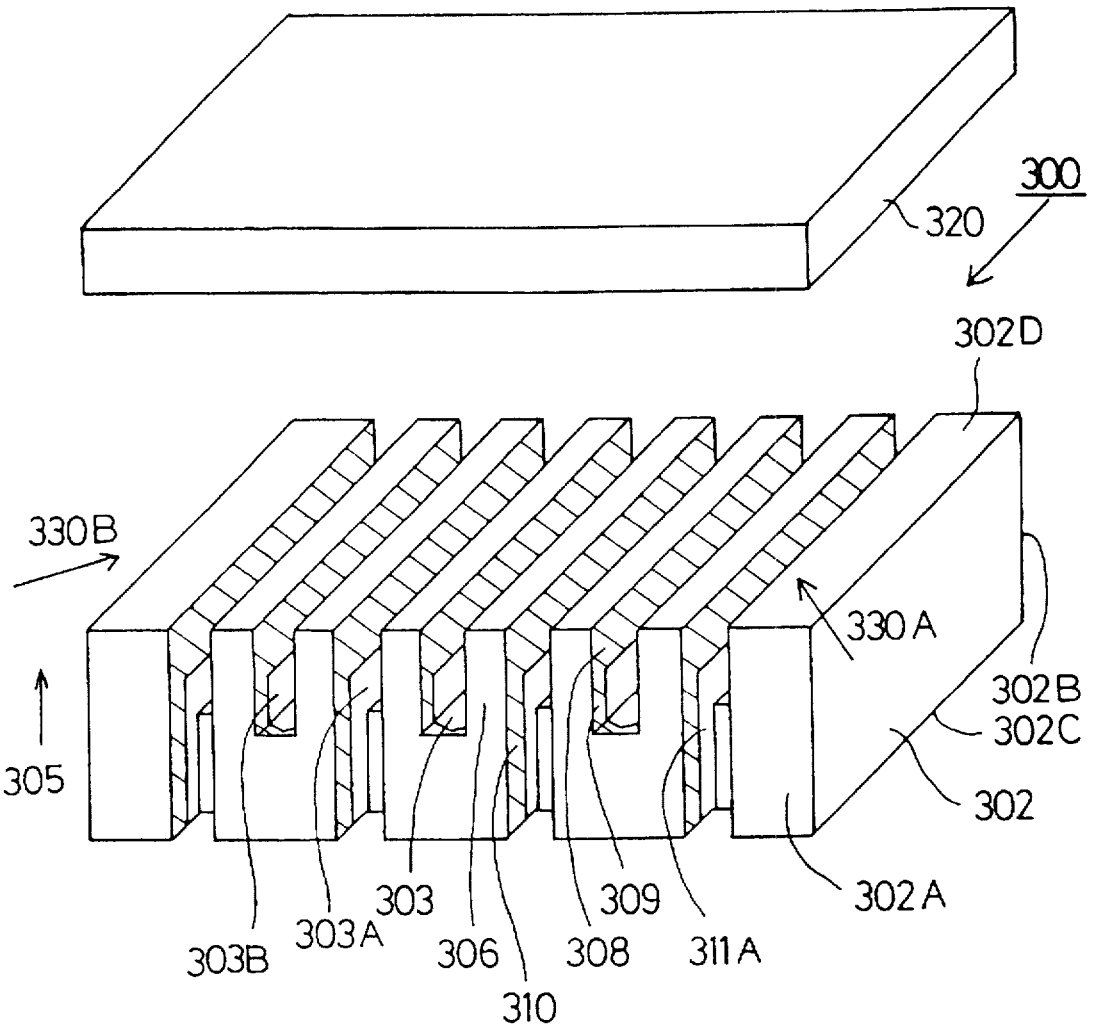
Fig.7 RELATED ART
FIG. 7 is a front perspective view of a second conventional ink ejecting device.
Figure 8:
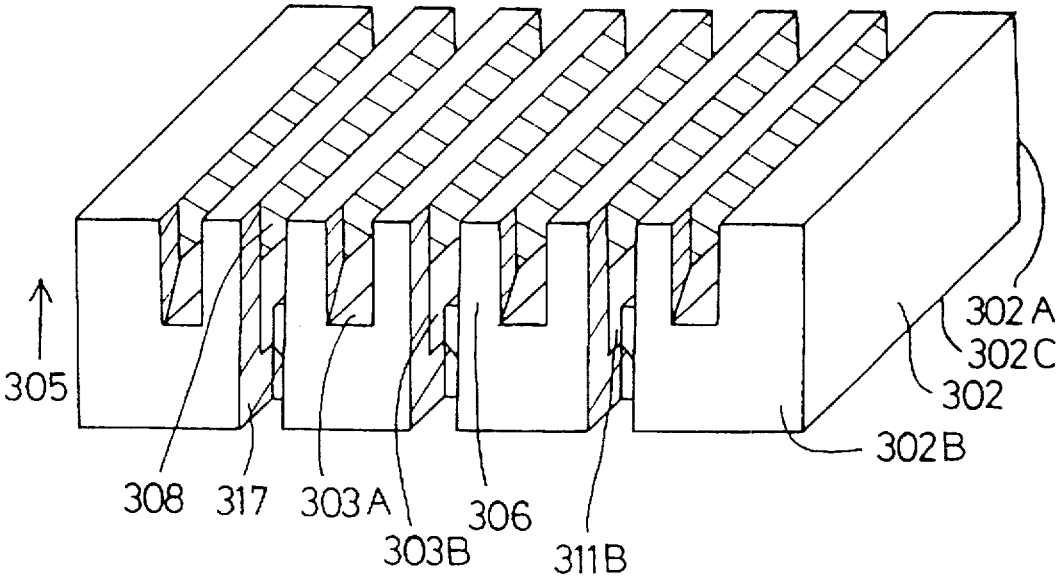
Fig.8 RELATED ART
FIG. 8 is a rear perspective view a piezoelectric ceramic plate of the second conventional ink ejecting device.

As shown in FIGS. 5A and 5B, in order to eject ink droplet from an ink channel 104B, a voltage pulse is applied through the wiring patterns 124 to the driving electrodes 108B and 108E formed on the partition walls 106B and 106C, respectively, which form the side walls of the ink channel 104B. The other driving electrodes 108 are grounded through the other wiring patterns 124 and the wiring pattern 125. As a result, an electric field in the direction indicated by an arrow 113B is formed in the partition wall 106B, and an electric field in the direction indicated by an arrow 113C is formed in the partition wall 106C. Thus, the partition walls 106B and 106C are deformed or deflected away from each other. Accordingly, the volume of the ink channel 104B increases and the pressure in the ink channel 104B at the periphery of the nozzle 211 is reduced.

This state is kept for a time period represented by L/a. The time period of L/a is the time needed for the pressure wave in the ink channel 104 to propagate one way in a longitudinal direction of the ink channel 104 from the corresponding slit 111B to the nozzle plate 21 (or vice versa). The time period L/a is determined by the length L of the ink channel 104 and the sound velocity a of the ink. During the time period L/a, additional ink is supplied from the manifold through the corresponding one of the second grooves 111B into the ink channel 104B.

According to the propagation theory of the pressure wave, the pressure wave in the ink channel 104B is inverted just after the time period L/a elapses. Thus, the pressure wave changes to a positive pressure. Synchronously with this timing, the voltage applied to the driving electrodes 108B and 108E is returned to 0 V. As a result, the partition walls 106B and 106C return to their non-deformed state, as shown in FIG. 5A, and the ink is pressurized. At this time, the positive pressure wave is added to the pressure generated when the partition walls 106B and 106C return to their non-deformed state. Thus, a relatively high pressure is applied to the ink in the ink channel 104B, so that an ink droplet is ejected from the nozzle 211.

Therefore, in this preferred embodiment, the driving voltage is first applied to increase the volume of the ink channel 104B. Then, the driving voltage is removed to reduce the volume of the ink channel 104B to its natural state. Accordingly, an ink droplet is ejected from the ink channel 104B. Alternately, the driving voltage is first applied to reduce the volume of the ink channel 104B, so that the ink droplet is ejected from the ink channel 104B. Then, the driving voltage is removed to increase the volume of the ink channel 104B from a volume-reduced state to its natural state, so that additional ink is supplied into the ink channel 104B.

In the ink ejection device 100 of the preferred embodiment, as described above, the grooves 103 and the slits 111A and 111B are designed so that the width of the grooves 103 are smaller than the width of the second grooves 111A and 111B. This design ensures the electrodes are electrically connected, even when positional deviations occur between the grooves 103 and the second grooves 111A and 111B, caused when the grooves 103 and the second grooves 111A and 111B are formed in different steps. That is, a desired area not being formed by the deposition from the directions 130A, 130B, 130C and 130D is prevented. The driving electrodes 108, the ejection channel led wire electrodes 109 (containing in-groove lead wire electrodes 120), the non-ejection channel lead wire electrodes 110 and the patterns 124 and 125 thus are surely formed at the desired areas.

Furthermore, the in-groove lead wire electrodes 120 of the ejection channel lead wire electrodes 109 are formed inside the grooves 103B, so that the electrical connection between the driving electrodes 108 and the ejection channel lead wire electrodes 109 through the step portions 121 can be performed with high reliability.

In this preferred embodiment, after the driving electrodes 108 of the grooves 103B are formed, the in-groove lead wire electrodes 120 are formed in the grooves 103B because of the deposition direction used to form the ejection channel lead wire electrodes 109. However, the in-groove lead wire electrodes may be formed in the grooves 103A.

Furthermore, in this preferred embodiment, the ink ejection device 100 is provided with the ink channels 104 and the air channels 127. However, this invention is applicable to an ink ejection device having no air channels 127. That is, the ink ejection device may be constructed so that all of the grooves 103 are used as ink channels. Thus, only the slits 111B are provided at the end portion 102B for the grooves of the piezoelectric ceramic plate.

Additionally, in this preferred embodiment, the second grooves 111A and 111B are designed so that they are wider than the width of the grooves 103 over the whole length of the second grooves 111A and 111B. However, the second grooves 111A and 111B may be designed so that their width is larger than the width of the grooves 103 only at a portion of the slits 111A and 111B corresponding to the intersection area between the driving electrodes 108 of the grooves 103 and the second grooves 111A and 111B.

While this invention has been described in conjunction with the specific embodiments outline above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink ejecting device, comprising:

an actuator plate having a top surface and a bottom surface;

a plurality of first grooves formed in the top surface of the actuator plate; and a plurality of second grooves formed in the actuator plate between the top and bottom surfaces, each of the second grooves connecting to a corresponding one of the first grooves;

wherein a width of each of the plurality of second grooves is larger than a width of the first grooves in at least an intersection area of the first and second grooves.

2. The ink ejection device of claim 1, further comprising:

a cover plate attached to the top surface of the actuator plate;

a nozzle plate attached to the actuator plate and the cover plate; and a plurality of nozzles formed in the nozzle plate, each of the nozzles connected to a corresponding one of the plurality of first grooves.

3. The ink ejection device of claim 1, further comprising:

first electrodes formed in prescribed areas on inner surfaces of the first grooves by using a shadow effect of side walls of the first grooves; and second electrodes formed on inner surfaces of the second grooves by using a shadow effect of side walls of the second grooves and electrically connected to the first electrodes.

4. The ink ejection device of claim 3, further comprising a step portion formed between each pair of intersecting first and second grooves, wherein the second electrodes are formed at portions of the inner surfaces of the first grooves beyond the step portions and are electrically connected to each of the first electrodes.

5. The ink ejection device of claim 1, wherein, in at least the intersection area, the width of the plurality of the second grooves is wider than the width of the plurality of the first grooves by at least twice an expected lateral displacement between the plurality of first grooves and the plurality of second grooves.

6. The ink ejection device of claim 1, wherein, in at least the intersection area, the width of the plurality of the second grooves is at least 10 μm greater than the width of the plurality of first grooves.

7. The ink ejection device of claim 1, wherein:

the plurality of first grooves extend between a first end and a second end of the actuator plate; and each of a first subset of the plurality of second grooves are formed in the first end of the actuator plate and each of a second subset of the plurality of second grooves are formed in the second end of the actuator plate.

8. An actuator plate of an ink ejecting device, comprising:

a top surface and a bottom surface;

a plurality of first grooves formed in the top surface of the actuator plate; and a plurality of second grooves formed in the actuator plate between the top and bottom surfaces, each of the second grooves connecting to a corresponding one of the first grooves;

wherein the width of each of the plurality of second grooves is larger than the width of the first grooves in at least an intersection area of the first and second grooves.

9. The actuator plate of claim 8, further comprising:

a cover plate attached to the top surface of the actuator plate;

a nozzle plate attached to the actuator plate and the cover plate; and a plurality of nozzles formed in the nozzle plate, each of the nozzles connected to a corresponding one of the plurality of first grooves.

10. The actuator plate of claim 8, further comprising:

first electrodes formed in prescribed areas on inner surfaces of the first grooves by using a shadow effect of side walls of the first grooves; and second electrodes formed on inner surfaces of the second grooves by using a shadow effect of side walls of the second grooves and electrically connected to the first electrodes.

11. The actuator plate of claim 10, further comprising a step portion formed between each pair of intersecting first and second grooves, wherein the second electrodes are formed at portions of the inner surfaces of the first grooves beyond the step portions and are electrically connected to each of the first electrodes.

12. The actuator plate of claim 8, wherein, in at least the intersection area, the width of the plurality of the second grooves is wider than the width of the plurality of the first grooves by at least twice an expected lateral displacement between the plurality of first grooves and the plurality of second grooves.

13. The actuator plate of claim 8, wherein, in at least the intersection area, the width of the plurality of the second grooves is at least 10 μm greater than the width of the plurality of first grooves.

14. The ink ejection device of claim 8, wherein:

the plurality of first grooves extend between a first end and a second end of the actuator plate; and each of a first subset of the plurality of second grooves are formed in the first end of the actuator plate and each of a second subset of the plurality of second grooves are formed in the second end of the actuator plate.

15. A method for manufacturing an actuator plate of an ink ejecting device, comprising:

providing the actuator plate having a top surface and a bottom surface;

forming a plurality of first grooves in the top surface of the actuator plate; and forming a plurality of second grooves in the actuator plate between the top and bottom surfaces, each of the second grooves connecting to a corresponding one of the first grooves;

wherein the width of each of the plurality of second grooves is larger than the width of the first is grooves in at least an intersection area of the first and second grooves.

16. The method for manufacturing the actuator plate of claim 15, further comprising:

attaching a cover plate to the top surface of the actuator plate;

forming a plurality of nozzles in a nozzle plate; and attaching the nozzle plate to the actuator plate and the cover plate, such that each of the nozzles is connected to a corresponding one of the plurality of first grooves.

17. The method for manufacturing the actuator plate of claim 15, further comprising:

forming first electrodes in prescribed areas on inner surfaces of the first grooves; and forming second electrodes on inner surfaces of the second grooves.

18. The method for manufacturing the actuator plate of claim 17, wherein the first electrodes forming and second electrode forming steps comprise:

using a shadow effect of side walls of the first grooves to form the first electrodes in the prescribed areas on inner surfaces of the first grooves; and using a shadow effect of side walls of the second grooves to form the second electrodes on inner surfaces of the second grooves.

19. The method for manufacturing the actuator plate of claim 17, wherein the second electrodes are electrically connected to the first electrodes.

20. The method for manufacturing the actuator plate of claim 15, wherein the second groove forming step comprises forming a step portion between each pair of intersecting first and second grooves, wherein the second electrodes are formed at portions of the inner surfaces of the first grooves beyond the step portions and are electrically connected to each of the first electrodes.

21. The method for manufacturing the actuator plate of claim 15, wherein, in at least the intersection area, the width of the plurality of the second grooves is wider than the width of the plurality of the first grooves by at least twice an expected lateral displacement between the plurality of first grooves and the plurality of second grooves.

22. The method for manufacturing the actuator plate of claim 15, wherein, in at least the intersection area, the width of the plurality of the second grooves is at least 10 μm greater than the width of the plurality of first grooves.

23. The method for manufacturing the actuator plate of claim 15, wherein:

the step of forming the plurality of first grooves comprises forming the plurality of first grooves extend a first end and a second end of the actuator plate; and the step of forming the plurality of second grooves comprises:

forming each of a first subset of the plurality of second grooves in the first end of the actuator plate, and forming each of a second subset of the plurality of second grooves in the second end of the actuator plate.

* * * * *